United States Patent [19]

Häseler et al.

[11] Patent Number: 4,933,264

[45] Date of Patent: Jun. 12, 1990

[54] PROCESS FOR PROCESSING A COLOR PHOTOGRAPHIC MATERIAL

[75] Inventors: Helmut Häseler, Leverkusen; Heinz Meckl, Bergisch Gladbach; Gustav Tappe, Leverkusen, all of Fed. Rep. of Germany

[73] Assignee: Agfa-Gevaert Aktiengesellschaft, Leverkusen, Fed. Rep. of Germany

[21] Appl. No.: 395,549

[22] Filed: Aug. 18, 1989

[30] Foreign Application Priority Data

Sep. 3, 1988 [DE] Fed. Rep. of Germany ..... 3830024

[51] Int. Cl.[5] ..... G03C 7/42

[52] U.S. Cl. ..... 430/372; 430/383; 430/393; 430/418; 430/460; 430/551

[58] Field of Search ..... 430/383, 393, 372, 418, 430/460, 551

[56] References Cited

U.S. PATENT DOCUMENTS 4,780,398 10/1988 Kim ..... 430/461

4,855,216 8/1989 Meckl et al. ..... 430/372

*Primary Examiner*—Paul R. Michl

*Assistant Examiner*—Janis L. Dote

[57] ABSTRACT

In a process for the processing of color photographic silver halide material which has been exposed to form an image by development, bleachfixing, washing or stabilization and drying, the aqueous developer solution being free from benzyl alcohol, the pH value of the bleachfixing solution, which contains an iron(III) complex salt, being below 7 and the bleachfixing solution containing a compound corresponding to general formula (I)

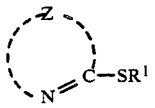

(I)

in which

Z represents the atoms required to complete an optionally further substituted heterocyclic ring and $R^1$ represents hydrogen or an alkali atom, and a coupler containing an activated methylene group, in which a hydrogen atom is replaced by alkyl, cycloalkyl, aryl or aralkyl and reacts with the oxidation product of the color developer to form colorless reaction products, bleaching can be carried out free from residual silver with a low regeneration level of the bleachfixing bath without any water-insoluble precipitates being formed.

9 Claims, No Drawings

PROCESS FOR PROCESSING A COLOR PHOTOGRAPHIC MATERIAL

This invention relates to a process for processing an exposed, color photographic, photosensitive silver halide material by development, bleachfixing, washing or stabilization and drying, the precipitation of poorly soluble residues being avoided by the use of compounds which couple to form colorless reaction products in the bleachfixing solution.

The developer solution used in the process according to the invention is free from benzyl alcohol. The pH value of the bleachfixing solution, which contains certain bleaching accelerators, is below 7.

The basic steps in the processing of photosensitive color materials are generally a color development step and a silver removal step. With reversal materials, there are the additional steps of preliminary black-and-white development and a second exposure.

In the last step, the silver produced during development is oxidized with a bleaching agent and dissolved by a fixing agent.

Removal of the silver can be carried out in two steps using a bleaching bath and a fixing bath or in one step using a bleachfixing bath.

Bleaching is mainly carried out using an iron(III) ion complex salt (for example an aminopolycarboxylic acid iron-(III) complex salt, more especially an iron(III) ethylenediaminetetraacetate complex salt). Iodoso compounds, persulfates, cobalt(III) ion complex salts and cerium(IV) ion complex salts are also suitable.

However, iron(III) ion complex salts show comparatively low oxidative power. Accordingly, there is a need to increase the bleaching power of the bleaching-/fixing solution which contains an iron(III) ion complex salt as bleaching agent.

To increase the bleaching power of a bleachfixing solution containing an iron(III) ion complex salt, such as iron(III) ethylenediaminetetraacetate, as bleach, it has been proposed to add various bleaching accelerators to the processing bath.

Examples of such bleaching accelerators include thiourea derivatives (JP-OS 8506/70, U.S. Pat. No. 3,706,561), selenourea derivatives (JP-OS 280/71), mercapto compounds having a 5-membered ring GB No. 1,138,842), thiazole derivatives and thiadiazole derivatives (CH-PS 336 257).

EP-A-0 270 217 describes a processing process in which the developer solution is free from benzyl alcohol and the pH value of the bleachfixing solution, which contains an iron(III) complex salt and a bleaching accelerator, is in the range from 3 to 6.8.

However, in the practical application of this process with minimal regeneration of the bleachfixing baths for both economic and financial reasons, poorly soluble residues are precipitated. With minimal regeneration, bleachfixing baths of the type in question contain only a little sulfite, particularly during prolonged intervals in their operation.

If, under these conditions, developer is carried over into the bleachfixing bath by the photographic material, the developer is oxidized by the bleach. The waterinsoluble developer oxidation products thus formed contribute considerably towards the contamination of the bleachfixing bath.

Another disadvantage of the process described above is the long bleachfixing time of 1 minute 30 seconds.

Now, the object of the present invention is to provide a process in which precipitation of the poorly soluble residues is avoided.

Another object of the invention is to provide a process in which the bleachfixing time is less than 1 minute.

The present invention relates to a process for the processing of color photographic silver halide material which has been exposed to form an image and which comprises on a layer support at least three photosensitive silver halide emulsion layers of different spectral sensitivity, with which a cyan coupler, a magenta coupler and a yellow coupler are associated, by development, bleachfixing, washing or stabilization and drying, the aqueous developer solution being free from benzyl alcohol, the pH value of the bleachfixing solution, which contains an iron(III) complex salt, being below 7 and the bleachfixing solution containing a compound corresponding to general formula (I)

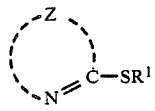

(I)

in which

Z represents the atoms required to complete an optionally further substituted heterocyclic ring and $R^1$ represents hydrogen or an alkali atom, characterized in that the bleachfixing solution contains a coupler containing an activated methylene group, in which a hydrogen atom is replaced by alkyl, cycloalkyl, aryl or aralkyl and reacts with the oxidation product of the color developer to form colorless reaction products.

Compounds corresponding to formula I are described in DE-PS 1 290 912.

The following are examples of suitable compounds for the process according to the invention:

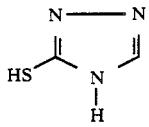

B-1

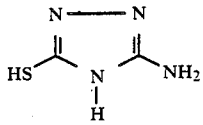

B-2

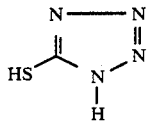

B-3

Compounds which couple to form colorless reaction products include compounds selected from the group consisting of pyrazolones, benzoyl and acetoacetic esters, benzoyl and acetoacetic acid anilides, cyanoacetyl compounds and cyanoacetamides, in which a hydrogen atom of the activated methylene group is replaced by alkyl, aryl or aralkyl.

The benzoyl and acetoacetic ester compounds suitable for use in accordance with the invention are prepared by the method described in Can. J. Chem. 31, page 1025 (1953).

Pyrazolone derivatives which couple to form colorless reaction products are described in DE-AS 1 155 675.

Suitable pyrazolones which couple to form colorless reaction products correspond to general formula II:

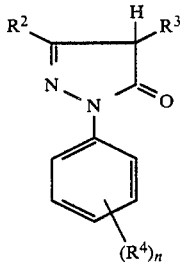

(II)

in which $R^2$, $R^3$ represent alkyl, alkoxy, aryl, carboxy, carboxyalkyl, $R^4$ represents halogen, —CN, $CF_3$, acylamino, sulfamoyl, alkylsulfamyl, —$SO_3H$, carboxy, carboxyalkyl, n=0–3.

The following preferred compounds are mentioned by way of example:

W-1

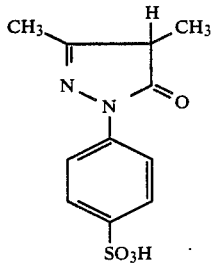

W-2

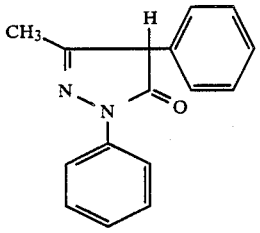

W-3

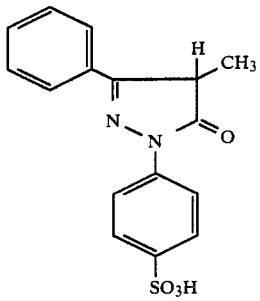

-continued

W-4

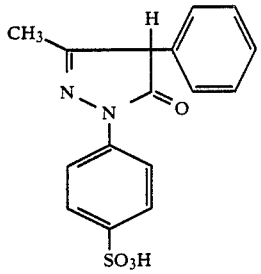

W-5

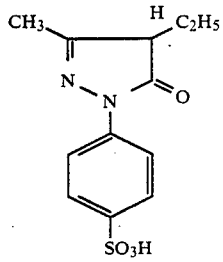

W-6

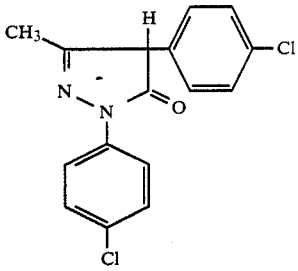

W-7

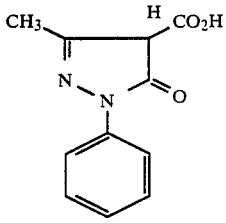

W-8

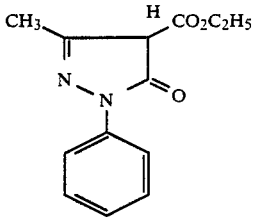

The pH value of the bleachfixing solution is in the range from 4.0 to 6.9 and preferably in the range from 4.7 to 6.2.

The bleachfixing time is preferably between 10 and 45 seconds.

The temperatures suitable for the bleachfixing treatment according to the invention are in the range from 20° to 40° C. and preferably in the range from 33° to 38° C.

The quantity of compounds corresponding to formula I in the bleachfixing bath varies according to the type of processing solution, the type of photographic material to be processed, the processing temperature, the time required to carry out the desired processing, etc. However, a quantity of 0.1 to 10 g per liter bleachfixing bath is suitable, a quantity of from 0.5 to 3 g/l being preferred. In general, the best range in each case is determined by simple preliminary tests. The compound to be used in accordance with the invention may be directly added to the bleachfixing bath or may be introduced through a preliminary conditioning bath.

The compounds which couple to form colorless reaction products are present in the bleachfixing bath in concentrations of from 0.1 to 30 g/l and preferably in concentrations of from 1 to 10 g/l.

The regeneration volume of the bleachfixing solution is from 50 to 110 ml per $m^2$ photographic material.

Suitable iron(III) ion complex salts are complexes of iron(III) ions and a chelating agent, such as an amino polycarboxylic acid or a salt thereof, more particularly an alkali metal salt or ammonium salt.

Typical examples of chelating agents are ethylenediamintetraacetic acid; disodium ethylenediaminetetraacetate; diammonium ethylenediaminetetraacetate; tetra-(trimethylammonium)-ethylenediaminetetraacetate; tetrapotassium ethylenediaminetetraacetate; tetrasodium ethylenediaminetetraacetate; trisodium ethylenediaminetetraacetate; diethylenetriaminepentaacetic acid; pentasodium diethylenetriaminepentaacetate; ethylenediamine-N-(β-hydroxyethyl)-N,N',N'-triacetic acid; trisodium ethylenediamine-N-(β-hydroxyethyl)-N,N',N'-triacetate; triammonium ethylenediamine-N-(β-hydroxyethyl)-N,N',N'-triacetate; propylenediaminetetraacetic acid; disodium propylenediaminetetraacetate; nitrilotriacetic acid; trisodium nitrilotriacetate; cyclohexanediaminetetraacetic acid; disodium cyclohexanediaminetetraacetate; nitrilotriacetic acid; trisodium nitrilotriacetate; cyclohexanediaminetetraacetic acid; disodium cyclohexandiaminetetraacetate; iminodiacetic acid; dihydroxyethyl glycine; ethylether diaminetetraacetic acid; glycol ether diaminetetraacetic acid; ethylenediaminetetrapropionic acid; phenylenediaminetetraacetic acid.

The iron(III) ion complex salt may be used in the form of the complex salt or may be prepared in situ in the bleachfixing bath. Suitable cations are alkali cations and ammonium, preferably ammonium.

The bleachfixing solution according to the invention may contain rehalogenating agents, such as bromides (for example potassium bromide, sodium bromide, ammonium bromide, etc.), chlorides (for example potassium chloride, sodium chloride, ammonium chloride, etc.) and the like in addition to the bleaching agent. In addition, additives which have a pH-buffering effect, such as inorganic acids, organic acids or the salts thereof which are commonly used in standard bleachfixing solutions (for example boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

Where the bleachfixing solution according to the invention is used in a bleachfixing bath, it is possible to use standard fixing agents, i.e. water-soluble agents which dissolve silver halide, such as thiosulfate (for example sodium thiosulfate, ammonium thiosulfate, ammonium sodium thiosulfate, potassium thiosulfate, etc.); thiocyanates (for example sodium thiocyanate; ammonium thiocyanate, potassium thiocyanate, etc.); thioether compounds (for example ethylene-bis-thiodiglycolic acid, 3,6-dithiaoctane-1,8-diol, etc.); and thioureas, either individually or in combinations of two or more. In addition, special bleachfixing agents containing a combination of a fixing agent and a large quantity of a halide compound, such as potassium iodide, may also be used.

The iron(III) ion complex salt is normally present in the bleachfixing composition in a quantity of from 0.1 to 1 mol/l. The quantity of fixing agent is generally between 0.2 and 4 mol per liter bleachfixing solution.

Bleachfixing solutions may additionally contain preservatives, such as sulfites (for example sodium sulfite, potassium sulfite, ammonium sulfite, etc.), hydroxylamine, hydrazine, aldehyde-bisulfite adducts (for example acetaldehyde-sodium bisulfite adduct), etc. They may also contain various optical brighteners, foam inhibitors, surfactants, organic solvents (for example methanol) and known bleachfixing accelerators, for example polyamine compounds (U.S. Pat No. 3,578,457), thioureas (U.S. Pat. No. 3,627,283), iodides (DE-PS 1,127,715), polyethylene oxides (DE-PS 966 410) and other thioureas.

The substances used for development in the process according to the invention are p-phenylenediamines and, in particular, N,N-dialkyl-p-phenylenediamines, in which the alkyl groups and the aromatic nucleus are substituted or unsubstituted. Examples of such compounds are N,N-diethyl-p-phenylenediamine hydrochloride, 4-N,N-diethyl-2-methyl phenylenediamine hydrochloride, 4N-ethyl-N-2-methanesulfonylaminoethyl)-2-methyl phenylenediamine sesquisulfate monohydrate, 4-N-ethyl-N-2-hydroxyethyl)-2-methyl phenylenediamine sulfate and 4-N,N-diethyl-2,2'-methanesulfonylaminoethyl phenylenediamine hydrochloride.

The color developer preferably contains complexing agents in an effective quantity for complexing iron ions and complexing agents in an effective quantity for complexing calcium ions, although both functions may also be performed by a single substance. The developer is suitable in particular for rapid processing, for example with a development time of 45 seconds, development being followed by bleachfixing and washing or stabilization. According to the invention,t he developer contains no benzyl alcohol.

The color developer is substantially bromide-free. This means that it may contain bromide ions in a sensitometrically negligible concentration. This quantity of bromide ions need not be added to the fresh developer, but instead may be dissolved out from the material to be developed during the development process. Its quantity should be limited to less than 30 mg/l.

The color developer according to the invention preferably contains chloride ions, more especially in a quantity of 1 to 5 g/l.

Susitable complexing agents for complexing calcium ions are, for example, aminopolycarboxylic acids which are well known per se. Typical examples of such aminopolycarboxylic acids are nitrilotriacetic acid, ethylenediaminetetraacetic acid (EDTA), 1,3-diamino-2-hydroxypropyltetraacetic acid, diethylenetriaminepentaacetic acid, N,N'-bis-(2-hydroxybenzyl)-ethylenediamine-N,N'-diacetic acid, hydroxyethyl ethylenediaminetriacetic acid, cyclohexanediaminotetraacetic acid and aminomalonic acid.

Other calcium complexing agents are polyphosphates, phosphonic acids, aminopolyphosphonic acids and hydrolyzed polymaleic anhydride, for example sodium hexametaphosphate, 1-hydroxyethane-1,1-diphosphonic acid, amino-tris-methylene phosphonic acid, ethylenediaminetetramethylene phosphonic acid. 1-Hydroxyethane-1,1-diphosphonic acid also acts as an iron complexing agent.

Other iron complexing agents are, for example, 4,5-dihydroxy-1,3-benzenedisulfonic acid, 5,6-dihydroxy-1,2,4-benzenetrisulfonic acid and 3,4,5-trihydroxybenzoic acid.

For complexing calcium, the calcium complexing agent is preferably used in a quantity of from about 0.2 to about 1.8 mol per mol developer substance.

The iron complexing agent is used in quantities of from about 0.02 to about 0.2 mol per mol developer substance.

The developer used in the process according to the invention is in particular an aqueous alkaline solution which has a pH value above 8 and more especially in the range from 9 to 13. This pH value is adjusted by buffers known per se, such as alkali carbonates and alkali phosphates.

In addition, it may be advisable to add whiteners and antioxidants to the developer solutions. Suitable antioxidants are, for example, hydroxylamine and diethylhydroxylamine and also sulfites which are preferably used in a quantity of up to 5 g/l.

Suitable further constituents are optical brighteners, lubricants, for example polyalkylene glycols, surfactants, stabilizers, for example heterocyclic mercapto compounds or nitrobenzimidazole, and agents for establishing the required pH value.

The silver halide emulsion layers of the color photographic recording material which is subjected to the processing process according to the invention preferably consist of 80 to 100 mol-% silver chloride, 0 to 20 mol-% silver bromide and 0 to 2 mol-% silver iodide. In a particularly preferred embodiment, they consist of 95 to 100 mol-% silver chloride, 0 to 5 mol-% silver bromide and 0 to 1 mol-% silver iodide.

The layer containing the cyan coupler is normally redsensitized, the layer containing the magenta coupler is normally green-sensitized and the layer containing the yellow coupler is normally blue-sensitized.

The ready-to-use solutions may be prepared from the individual constituents or from so-called concentrates. In concentrates, the individual constituents are present in solution in much higher concentrations. The concentrates are prepared in such a way that a so-called regenerator may be prepared from them, i.e. a solution which contains somewhat higher concentrations of the individual constituents than the ready-to-use solution on the one hand gives a ready-to-use solution through further dilution and addition of a starter, preferably KCl, and on the other hand is continuously added to an in-use developer solution to replace the chemicals consumed during development or removed from the developer solution by overflow or by the developed material. Chloride ions normally need not be added, except to the freshly prepared developer, because chloride ions are released from the photographic material by development.

In the process according to the invention, no poorly soluble residues are precipitated in the bleachfixing bath. In addition, color photographic material can be completely bleached in less than 45 seconds for a regeneration level of 50 to 110 ml/m$^2$ photographic material.

EXAMPLES

Example 1

This Example demonstrates the way in which white couplers of the 4-substituted pyrazolone type work in a model test which simulates the practical situation under controlled conditions.

Comparison Test:

A mixture is prepared from a color developer solution and a low-sulfite bleachfixing bath which contains no white coupler.

| | |
|---|---|
| Composition of the developer solution: | |
| Water | 800 ml |
| Ethylenediaminetetraacetic acid (EDTA) | 3.0 g |
| 4,5-Dihydroxy-1,3-benzenedisulfonic acid, disodium salt | 0.3 g |
| Sodium chloride | 2.0 g |
| Triethanolamine | 8.0 g |
| N,N-diethyl hydroxylamine, 85% by weight | 5.0 ml |
| 4-(N-ethyl-N-2-methanesulfonylaminoethyl)-2-methylphenylenediamine sesquisulfate monohydrate (CD 3) | 5.0 g |
| Potassium carbonate | 25.0 g |
| make up with water to 1 liter; pH 10 | |
| Composition of the bleachfixing bath: | |
| Water | 800 ml |
| Ammonia solution, 25% by weight | 3 ml |
| 3-Mercapto-1,2,4-triazole | 1 g |
| Sodium sulfite, sicc. | 2 g |
| Ammonium thiosulfate | 100 g |
| Ammonium-iron ethylenediaminetetraacetic acid | 50 g |
| make up with water to 1 liter; adjust pH to 4.8 with acetic acid. | |

Preparation of the mixture:

250 ml developer solution are added with stirring to 250 ml bleachfixing bath.

The pH is adjusted to 6.5 with acetic acid.

Storage of the mixture:

An open glass beaker having the following measurements is used: height 120 mm, diameter 100 mm, filling volume 500 ml mixture, room temperature approx. 22° C.

Test according to the invention:

A mixture is prepared in the same way as in the Comparison test except that it contains 3,4-di-methyl-1-(4-sulfophenyl)-5-pyrazolone.

| | |
|---|---|
| Composition of the color developer solution: as Comparison test | |
| Composition of the bleachfixing bath: | |
| Water | 800 ml |
| Ammonia solution, 25% by weight | 3 ml |
| 3-Mercapto-1,2,4-triazole | 1 g |
| 3,4-Dimethyl-1-(4-sulfophenyl)-5-pyrazolone | 5 g |
| Sodium sulfite, sicc. | 2 g |
| Ammonium thiosulfate | 100 g |
| Ammonium-iron ethylenediaminetetraacetic acid | 50 g |
| make up with water to 1 liter, adjust pH to 4.8 with acetic acid. | |

The mixture is prepared and stored in the same way as in the Comparison test.

Result:

In the mixture of the Comparison test, waterinsoluble, blue to brown colored precipitates are formed at the surface and in the evaporation range after storage for only a few days.

The mixture in which the bleachfixing bath has the composition according to the invention does not show any such precipitation.

Example 2

This Example demonstrates bleachfixing free from silver halide in 45 seconds using the process according to the invention.

A color photographic recording material suitable for the processing process according to the invention was prepared by applying the following layers in the order indicated to a layer support of paper coated on both sides with polyethylene. The quantities shown are each based on 1 square meter. For the silver halide applied, the corresponding quantities of $AgNO_3$ are shown.

Layer combination 1:

1st Layer (substrate layer):
- 0.2 g gelatine

2nd Layer (blue-sensitive layer):
- blue-sensitive silver halide emulsion (99.5 mol-% chloride, 0.5 mol-% bromide, mean grain diameter 0.8 μ) of 0.63 g $AgNO_3$ containing
- 1.38 g gelatine
- 0.95 g yellow coupler Y
- 0.2 g white coupler W
- 0.29 g tricresylphosphate (TCP)

3rd Layer (protective layer)
- 1.1 g gelatine
- 0.06 g 2,5-dioctyl hydroquinone
- 0.06 g dibutyl phthalate (DBP)

4th Layer (green-sensitive layer)
- green-sensitized silver halide emulsion (99.5 mol-% chloride, 0.5 mol-% bromide, mean grain diameter 0.6 μ) of 0.45 g $AgNO_3$ containing
- 1.08 g gelatine
- 0.41 g magenta coupler M
- 0.16 g α-(3-t-butyl-4-hydroxyphenoxy)-myristic acid ethyl ester
- 0.08 g 2,5-dioctyl hydroquinone
- 0.34 g DBP
- 0.04 g TCP 5th Layer (UV-absorbing layer)
- 1.15 g gelatine
- 0.6 g UV absorber corresponding to the following formula

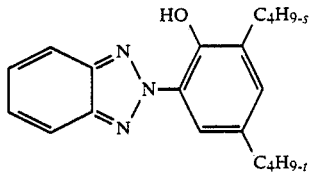

- 0.045 g 2,5-dioctyl hydroquinone
- 0.04 g TCP

6th Layer (red-sensitive layer) red-sensitized silver halide emulsion (99.5 mol-% chloride, 0.5 mol-% bromide, mean grain diameter 0.5 μ) of 0.3 g $AgNO_3$ containing
- 0.75 g gelatine
- 0.36 g cyan coupler C
- 0.36 g TCP 7th Layer (UV-absorbing layer)
- 0.35 g gelatine
- 0.15 g UV absorber as for 5th layer
- 0.2 g TCP 8th Layer (protective layer)
- 0.9 g gelatine
- 0.3 g hardener H corresponding to the following formula

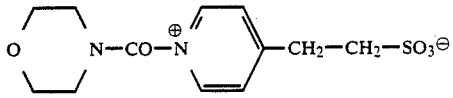

The components used correspond to the following formulae:

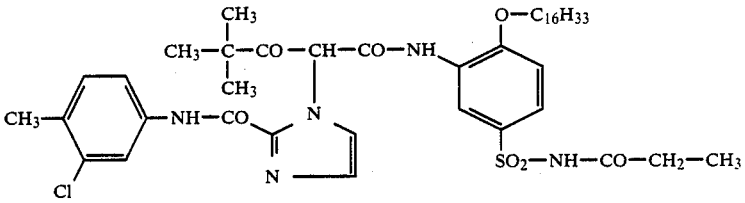

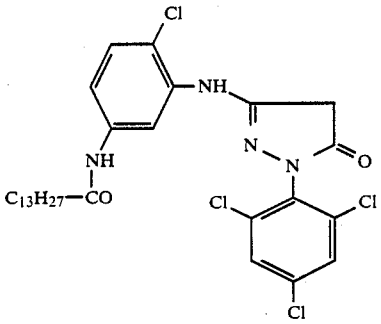

-continued

C

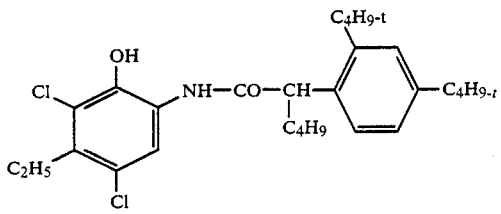

W

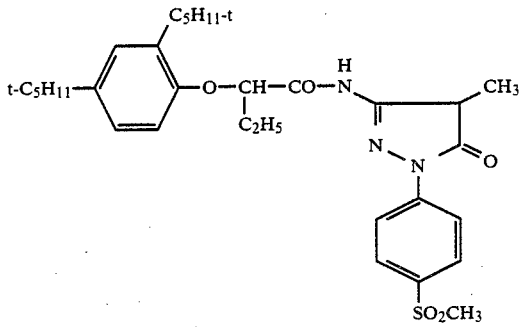

A step wedge is exposed onto the photographic recording material described above and processed as follows:

| | | |
|---|---|---|
| Color developer | 45 s | 35° C. |
| Bleachfixing bath | 45 s | 25° C. |
| Washing | 90 s | 25° C. |
| Drying | | |

The individual processing baths had the following composition:

| | |
|---|---|
| Color developer | |
| Water | 800 ml |
| Ethylenediaminetetraacetic acid (EDTA) | 3.0 g |
| 4,5-Dihydroxy-1,3-benzenedisulfonic acid, disodium salt | 0.3 g |
| Sodium chloride | 2.0 g |
| Triethanolamine | 8.0 g |
| N,N-diethy hydroxylamine, 85% by weight | 5.0 ml |
| 4-(N-ethyl-N-2-methanesulfonylaminoethyl)-2-methyl phenylenediamine sesquisulfate monohydrate (CD3) | 5.0 g |
| Potassium carbonate | 25.0 g |
| make up with water to 1 liter; pH 10 | |
| Bleachfixing bath | |
| Water | 800 ml |
| Ammonia solution, 25% by weight | 5 ml |
| 3-Mercapto-1,2,4-triazole | 1 g |
| 3,4-Dimethyl-1-(4-sulfophenyl)-5-pyrazolone | 5 g |
| Sodium sulfate, sicc. | 5 g |
| Ammonium thiosulfate | 100 g |
| Ammonium-iron ethylenediaminetetraacetic acid | 50 g |
| Silver chloride | 13.4 g |
| make up with water to 1 liter; adjust pH to 6.0 with ammonia or acetic acid. | |

Determination of residual silver

The exposed step wedge of the photographic material processed as described aboe was examined for residual silver in the black areas of the image using a Photo-Matic PM 8030 infrared silver detector (Photo-Matic, Denmark).

The processed sample contains no residual silver.

What is claimed is:

1. A process for the processing of color photographic silver halide material which has been exposed to form an image and which comprises on a layer support at least three photosensitive silver halide emulsion layers of different spectral sensitivity, with which a cyan coupler, a magenta coupler and a yellow coupler are associated, by development, bleachfixing, washing or stabilization and drying, the aqueous developer solution being free from benzyl alcohol, the pH value of the bleachfixing solution, which contains an iron(III) complex salt, being below 7 and the bleachfixing solution containing a compound corresponding to general formula (I)

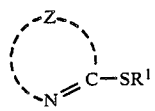

(I)

in which

Z represents the atoms required to complete an optionally further substituted heterocyclic ring and $R^1$ represents hydrogen or an alkali atom, characterized in that the bleachfixing solution contains a coupler containing an activated methylene group, in which a hydrogen atom is replaced by alkyl, cycloalkyl, aryl or aralkyl and reacts with the oxidation product of the color developer to form colorless reaction products.

2. A process as claimed in claim 1, characterized in that the compounds coupling to form colorless reaction products which are used in the bleachfixing solution correspond to general formula (II)

in which $R^2$, $R^3$ represent alkyl, alkoxy, aryl, carboxy, carboxyalkyl, $R^4$ represents halogen, —CN, $CF_3$, acylamino, sulfamoyl, alkylsulfamyl, —$SO_3H$, carboxy, carboxyalkyl, n=0–3.

3. A process as claimed in claim 1, characterized in that the bleachfixing bath contains a compound corresponding to formula I in a quantity of 0.1 to 10 g/l.

4. A process as claimed in claim 1, characterized in that the bleachfixing bath contains a compound corresponding to formula II in a quantity of 0.1 to 30 g/l.

5. A process as claimed in claim 1, characterized in that the bleachfixing step is completed in a time of 10 to 45 seconds.

6. A process as claimed in claim 1, characterized in that the temperature in the bleachfixing bath is between 20° and 40° C.

7. A process as claimed in claim 1, characterized in that the concentration of the developer substances, bleaching substances and fixing agents is kept constant by corresponding regenerating solutions.

8. A process as claimed in claim 7, characterized in that the regeneration volume of the bleachfixing bath corresponds to between 50 and 110 ml per $m^2$ photographic material.

9. A process as claimed in claim 1, characterized in that the silver halide emulsion layers of the color photographic recording material, which is subjected to the processing process according to the invention, consist of 80 to 100 mol-% silver chloride, 0 to 20 mol-% silver bromide and 0 to 2 mol-5 silver iodide.

* * * * *